United States Patent [19]

Alonso

[11] 4,178,822

[45] Dec. 18, 1979

[54] MUSICAL SYNTHESIS ENVELOPE CONTROL TECHNIQUES

[76] Inventor: Sydney A. Alonso, Strafford, Vt. 05072

[21] Appl. No.: 804,361

[22] Filed: Jun. 7, 1977

[51] Int. Cl.[2] ..... G10H 1/00; G10H 3/00

[52] U.S. Cl. ..... 84/1.01; 84/1.13; 84/1.27

[58] Field of Search ..... 84/1.01, 1.03, 1.11–1.13, 84/1.19–1.23, 1.26, 1.27; 364/718

[56] References Cited

U.S. PATENT DOCUMENTS

| | | | |
|---|---|---|---|
| 3,515,792 | 6/1970 | Deutsch | 84/1.03 |
| 4,000,675 | 1/1977 | Futumase et al. | 84/1.01 |
| 4,003,003 | 1/1977 | Haeberlin | 332/11 R |
| 4,018,121 | 4/1977 | Chouning | 84/1.01 |
| 4,026,179 | 5/1977 | Futamase | 84/1.24 |
| 4,033,219 | 7/1977 | Deutsch | 84/1.03 |
| 4,085,644 | 4/1978 | Deutsch et al. | 84/1.01 |
| 4,121,490 | 10/1978 | Deutsch | 84/1.27 |

*Primary Examiner*—Vit W. Miska

[57] ABSTRACT

The disclosure describes improved apparatus for synthesizing an audible note from its volume, attack-decay envelope and waveshape characteristics. By employing multiplying analog-to-digital converters, the characteristics can be rapidly generated and combined in real time, thereby enabling the use of the synthesis in performing instruments.

12 Claims, 5 Drawing Figures

| | Nfa | COUNTER | (END) |
|---|---|---|---|
| ATT | TRUE | ≤7after Nfa | FALSE |
| SUS | TRUE | >7after Nfa | FALSE |
| DEC | TRUE | ≤7after(END) | TRUE |

MUSICAL SYNTHESIS ENVELOPE CONTROL TECHNIQUES

BACKGROUND AND SUMMARY OF THE INVENTION

This invention relates to electronic apparatus for producing music, and more particularly relates to such apparatus in which the characteristics of the notes are produced by digital circuitry.

In recent years, digital circuitry has been gaining favor for use in electronic musical instruments and synthesizers due to its high reliability, accuracy and cost effectiveness. Ideally, the digital circuitry should produce numbers representing a variety of different characteristics of each musical note, such as waveform, fundamental frequency, volume, decay envelope and attack envelope. However, the known techniques for designing such circuitry are so complex that they have not resulted in a commercially-feasible product. The failure of the industry to overcome these design complexities has been a major stumbling block to the development of an all-digital synthesizer. One of the principal design problems is that normal digital circuitry requires a long time to calculate the ultimate composite characteristics of a note—too long for purposes of a performing-type instrument which must instantaneously respond to the touch of a performer.

As a result of these difficulties, past electronic musical synthesizers and instruments have used a combination of analog and digital techniques. For example, the waveshape information may be produced in the form of digital numbers, but the volume information is produced by means of an analog signal which controls the amplitude of an output amplifier. Such an approach is a compromise to an all-digital system, which reduces reliability and introduces sources of error. In addition, individual control over each note is sharply reduced.

Accordingly it is an object of the present invention to provide an electronic musical instrument or synthesizer in which the characteristics of individual notes are generated and combined digitally.

It is another object of the present invention to provide an instrument or synthesizer of the foregoing type in which individual notes are synthesized by generating separate amplitude and waveshape characteristics.

Still another object of the present invention is to provide an instrument or synthesizer of the foregoing type in which each musical note is digitally-generated by producing numbers corresponding to the volume, attack-decay envelope, waveshape and fundamental frequency of the note.

Yet another object of the invention is to provide a synthesizer or instrument of the foregoing type in which the digital numbers are combined by converting one of the numbers to an analog signal and then multiplying the analog signal times one of the other digital numbers.

By employing the techniques described herein, an electronic musical instrument or synthesizer can be produced which is capable of digitally controlling the essential characteristics of two or more notes played simultaneously with sufficient speed to operate as a performing instrument on a real time basis.

DESCRIPTION OF THE DRAWINGS

These and other objects, advantages and features of the present invention will hereafter appear in connection with the accompanying drawings wherein.

DESCRIPTION OF THE PREFERRED EMBODIMENT

Figure 1:
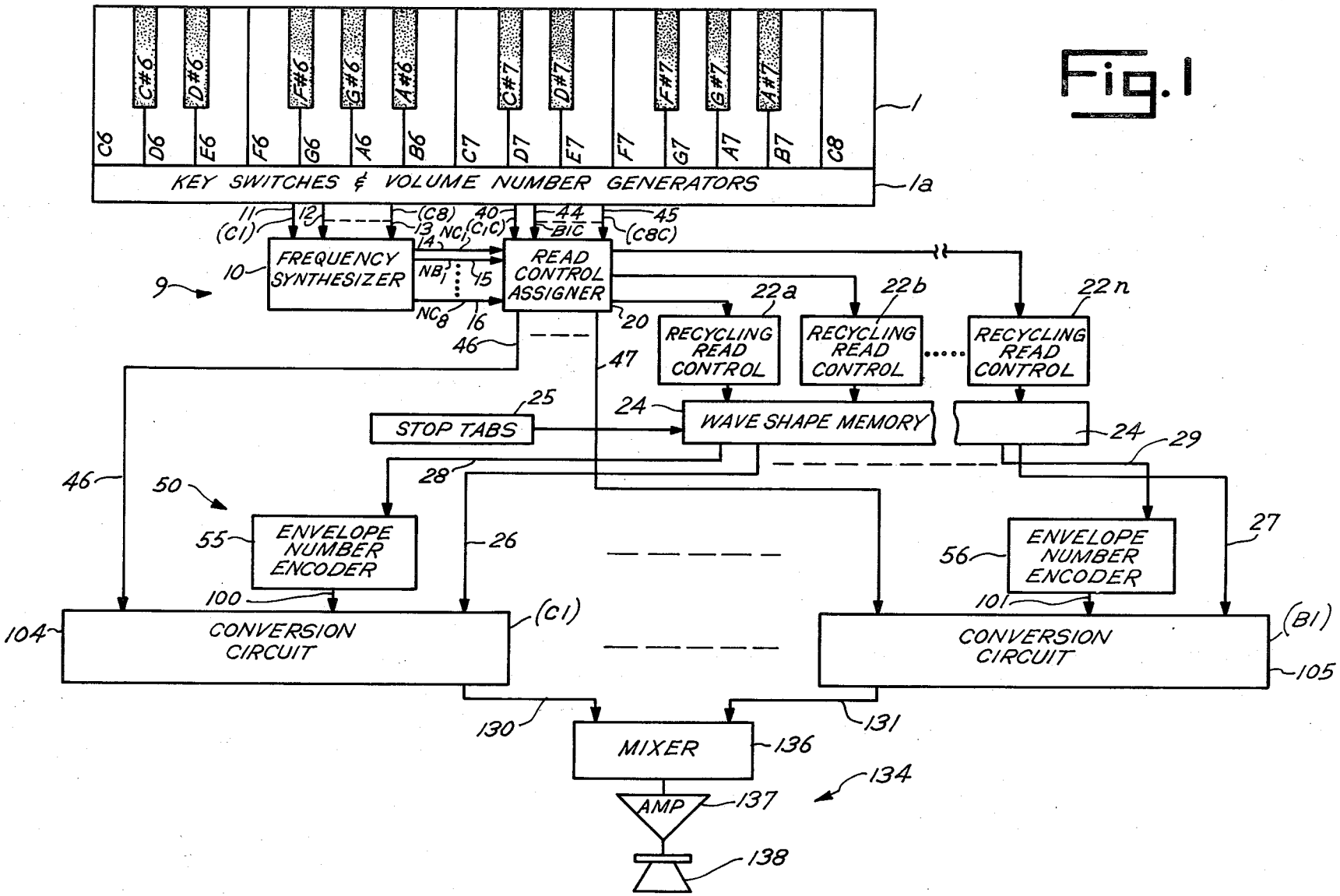
FIG. 1 is a schematic block diagram of a preferred form of electronic apparatus made in accordance with the present invention.

Referring to FIG. 1, a preferred form of apparatus made in accordance with the present invention basically comprises a keyboard 1, a key switch and volume number generator assembly 1*a*, a waveshape number generator 9, an attack-decay envelope number generator 50, conversion circuits 104, 105 and an output system 134. The apparatus basically divides the characteristics of each note into two parts:

(1) an amplitude characteristic; and (2) a waveshape-frequency characteristic. The amplitude characteristic, in turn, is divided into two components:

(1) a volume component; and (2) an attack or decay envelope component. Waveshape number generator 9 generates numbers representing the waveshape-frequency characteristic; key switch and volume number generator assembly 1*a* generates numbers representing the volume component of the note amplitude; and envelope number generator 50 generates numbers representing the envelope component of the note amplitude.

Referring to FIG. 1, keyboard 1 includes keys representing each of the notes of a typical piano keyboard from C1 (32 Hz.) to C8 (4,096 Hz.). In order to simplify the drawings, only keys C6–C8 are shown in FIG. 1. The keys are depressed by a performer in order to generate the musical notes corresponding to the legends drawn on the keys in FIG. 1.

Figure 2A:
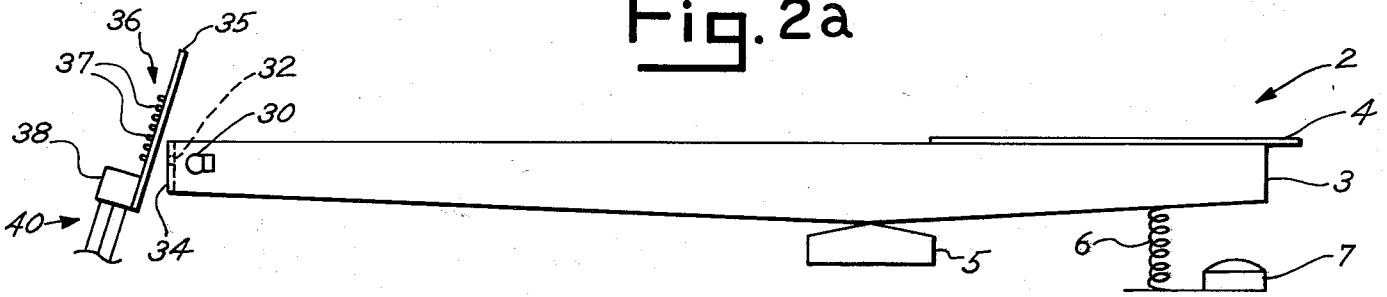
FIG. 2*a* is a schematic, partially fragmentary side-elevational view of a key and volume number generator made in accordance with the present invention.
Figure 2B:
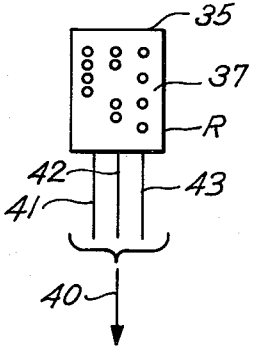
FIG. 2*b* is a front-elevational view of a portion of the apparatus shown in FIG. 2*a;*

Referring to FIG. 2*a*, an exemplary key 2 corresponding to note C1 is schematically illustrated. The key includes a body 3 which is covered by a finger plate 4. The key is pivotally-mounted on a fulcrum 5, and is biased by a spring 6 to the rest position shown. The lower extreme of the key travel is adjusted by a stop pad 7. The rear end of the key is fitted with a light bulb 30 which projects a beam of light through a narrow horizontal slot 32 in an end plate 34. The horizontal beam of light falls on a sensor board 35 which is fitted with a volume number encoder circuit 36 comprising photo-diodes 37 and a driver circuit 38. As shown in FIG. 2*b*, the photo-diodes are arranged in the form of a binary code. As the key is depressed downward, the horizontal light beam sweeps upward across the pattern of diodes. As each row of diodes is crossed, a different binary code is generated on a 3-bit volume line 40 including conductors 41–43. As the key is moved, circuit 38 produces time-spaced volume numbers representing the average volume of the note. Obviously, the performer can change the volume number by depressing the key to a greater or lesser extent. By proper manipulation, the performer can generate a time-spaced series of digital volume numbers representing the volume component of the note amplitude.

All of the keys on the keyboard 1 have a similar volume number encoder circuit so that a separate volume number can be generated for each of the notes desired to be played. At any point in time, each of the volume numbers can be different.

Referring to FIG. 1, waveshape number generator 9 includes a frequency synthesizer 10 which receives a separate key signal from the key switches operated by each of the keys. Exemplary conductors 11, 12 and 13 corresponding to the switches operated by notes C1, B1 and C8 are illustrated. In a well-known manner, frequency synthesizer 10 produces a different series of output pulses for each different note on the keyboard. Each of the series of pulses has a different repetition rate which is related to the fundamental frequency of the corresponding note by a constant N. Exemplary conductors 14, 15 and 16 corresponding to notes C1, B1 and C8, respectively, are illustrated in FIG. 1.

The output of synthesizer 10 is transmitted to a read control assigner 20. Assigner 20 serves the function of recognizing the presence of a clock signal on one of the output lines (e.g., lines 14, 15 or 16) from synthesizer 10 and of connecting that output line to a recycling read control circuit 22 which is not then in use. As shown in FIG. 1, a variety of recycling read control circuits may be utilized. Three such circuits are illustrated as **22*a*, 22*b* and 22*n***. The number of recycling read control circuits is a matter of design choice and could be limited to ten for some types of keyboard performance. However, as many read control circuits as desired can be used in the instrument.

Figure 3:
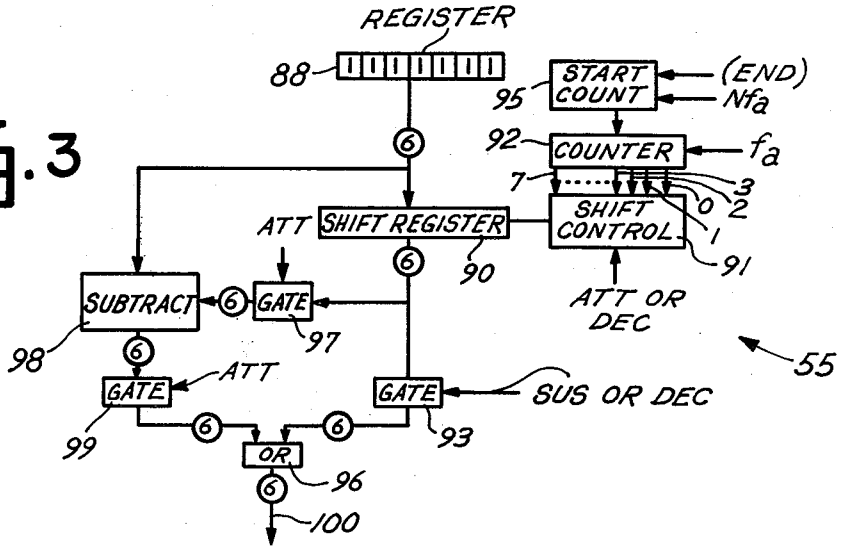
FIG. 3 is an electrical schematic diagram and truth table illustrating a preferred form of envelope number encoder made in accordance with the present invention.

Waveshape number generator 9 also includes a waveshape memory 24 which contains a digital representation of one or more waveshapes. When a particular keyboard switch is depressed, the clock pulses produced by synthesizer 10 serve as a time base for the assigned recycling read control 22. Read control 22 repetitiously reads out the stored digital representation of the waveshape, one digital word at a time, at a rate corresponding to the clock signal received from synthesizer 10. Memory 24 reads out a different series of time-spaced wave numbers for each key depressed on the keyboard 1. Each of the time-spaced series of digital wave numbers represents the waveshape and fundamental frequency characteristics of the assigned note at discrete instants in time. The type of wave-shape readout memory 24 may be controlled by one or more stop tabs 25. One exemplary form of detailed circuitry corresponding to synthesizer 10, read control assigner 20, recycling read controls 22, waveshape memory 24 and stop tabs 25 is described in U.S. Pat. No. 3,515,792 (Deutsch-June 2, 1970). An alternative embodiment of synthesizer 10 is illustrated in the copending application Ser. no. 804,535 entitled, "Musical Note Oscillator" filed contemporaneously with this application in the name of Sydney Alonso, now U.S. Pat. No. 4,108,033. An alternative embodiment of read controls 22 which can be used in connection with the "Musical Note Oscillator" is illustrated in FIG. 3 of the application Ser. No. 804,363 entitled "Electronic Music Sampling Techniques", filed contemporaneously with this application in the name of Sydney Alonso.

The wave numbers corresponding to each note are processed by a separate conversion circuit; therefore, a separate conversion circuit is provided for each different recycling read control. In this embodiment, ten conversion circuits are employed. Since all of the conversion circuits are identical, only two such circuits are shown in FIG. 1: conversion circuit 104 corresponding to note C1 and conversion circuit 105 corresponding to note B1. The manner in which memory 24 is interconnected with conversion circuits 104, 105 may be understood with reference to FIG. 4 of the above-identified Deutsch Patent. In this embodiment, conversion circuit 104 would be connected to the output of gate **75*a* corresponding to note C1 and conversion circuit 105 would be connected to the output of gate 75*b* corresponding to note B1. Of course, any of the notes from keyboard 1 could be assigned to conversion circuits 104, 105, depending on the manner in which read control assigner 20 operates. It also should be noted that a variety of control signals are transmitted over conductors 28 and 29 from waveshape memory 24**. In particular, the $Nf_a$, $Nf_b$, fa and fb signals are transmitted in the manner described in the Deutsch Patent.

Referring to FIG. 1, the volume numbers associated with each key are transmitted over individual multi-conductor lines to read control assigner 20. Only three of the lines, 40, 44 and 45 corresponding to notes C1, B1 and C8, respectively, are illustrated. Read control assigner 20 recognizes the presence of volume number signals on one of the volume number lines from the volume number generators and connects that line to a conversion circuit which is not in use. The volume number signals are conducted to the assigned conversion circuits over individual multi-conductor lines, such as lines 46, 47. A separate line is provided for each conversion circuit. In addition, the recycling read control circuits and conversion circuits are assigned in pairs to generate and process the volume numbers and wave numbers corresponding to the same note. For example, read control assigner 20 would assign conversion circuit 104 to receive the volume numbers and the wave numbers corresponding to note C1 over conductors 46 and 26, respectively. In order to achieve this result, recycling read control **22*a* is assigned to receive the output from synthesizer 10 corresponding to note C1. Likewise, assigner 20 would assign conversion circuit 105 to receive the volume numbers and the wave numbers corresponding to note B1 over conductors 47 and 27, respectively. The manner in which read control assigner 20** accomplishes its functions is analogous to the selection of an unused input or output device by an on-line computer, and applicable circuitry is well known to those skilled in the computer art.

Attack-decay envelope generator 50 is responsible for generating a time-spaced series of digital envelope numbers representing the attack or decay envelope component of the amplitude of a note at discrete instants in time. One exemplary circuit for accomplishing this function is described in the above-identified Deutsch Patent. As explained in connection with FIG. 8 of the Deutsch Patent, a one-shot multivibrator associated with each key on the keyboard produces an END pulse which enables the decay control circuitry to operate. In the example shown in FIG. 1 of the present application, an END pulse would be transmitted to encoder 55 in connection with the production of an envelope number for note C1. Similarly, in connection with the production of an envelope number for note B1, a different END pulse would be transmitted to encoder 56.

A separate envelope number encoder is used for each conversion circuit. Each of the encoders is identical and can be understood from the following description of exemplary envelope number encoder 55 which is illustrated in FIG. 3. The apparatus of FIG. 3 corresponds identically to the apparatus shown in FIG. 9 of the Deutsch Patent, except that it employs a register 88 which is continuously loaded with binary ones. The circuit operates in the manner described in the Deutsch Patent in order to produce a series of envelope numbers corresponding to the envelope of a desired note. This series of envelope numbers is transmitted over a 6-bit line 100 to conversion circuit 104. Similarly, the series of envelope numbers produced by envelope number encoder 56 for note B1 is transmitted over a 6-bit line 101 to conversion circuit 105.

Figure 4:
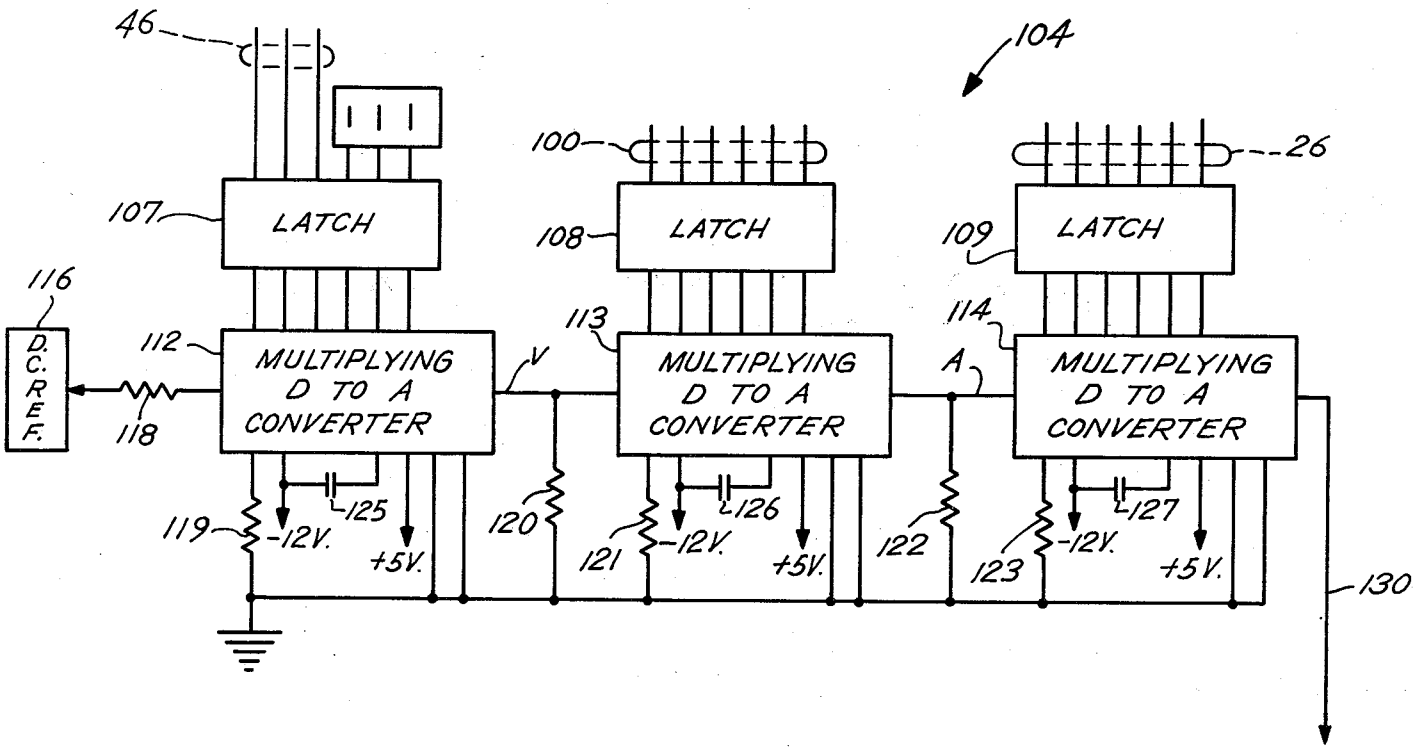
FIG. 4 is an electrical schematic diagram of a preferred form of the conversion circuit shown in block form in FIG. 1.

Each of the conversion circuits is identical and eacn one is used to produce a tone signal corresponding to a single note indicated by the depression of a single key on keyboard 1. Referring to FIG. 4, exemplary conversion circuit 104 includes digital latches 107–109 and multiplying D-to-A converters 112–114 connected as shown. A DC reference voltage supply 116 produces a DC voltage having a value approximately equal to one volt. Resistors 118–123 and capacitors 125–127 are connected as shown. The conversion circuit converts the digital tone characteristics introduced in the form of digital volume, envelope and wave numbers into a composite analog tone signal which is transmitted to the output system over conductor 130. Each of the multiplying D-to-A converters is identical and may be implemented by Model No. MC1408 manufactured by Motorola Inc.

The operation of the circuitry shown in FIG. 4 will be briefly described. Converter 112 multiplies the value of the DC reference signal from source 116 times the digital volume numbers present on data line 46 in order to produce an analog volume signal V. The volume signal is transmitted as the analog input to converter 113 which multiplies the value of V times the value of the envelope numbers transmitted over data line 100. The multiplication performed by converter 113 results in an analog amplitude signal A having an amplitude which represents the combined volume and envelope characteristics of the desired tone signal. Converter 114 multiplies the value of amplitude signal A times the wave numbers transmitted over data line 26 in order to produce an analog tone signal on conductor 130 which corresponds to the volume, envelope, waveshape and fundamental frequency characteristics represented by the volume, envelope and waveshape digital numbers for note C1. During each of the multiplications performed by converters 112–114, the digital number portion of the input is treated as a fraction.

The same process is used by conversion circuit 105 in order to produce a tone signal corresponding to note B1. The tone signal is transmitted over conductor 131 to a conventional audio mixer 136. The mixed tone signals then are amplified by a conventional audio amplifier 137 and converted into an audible sound by a conventional loudspeaker transducer 138 (FIG. 1).

Those skilled in the art will recognize that the single embodiment described herein may be modified and altered without departing from the true spirit and scope of the invention as defined in the accompanying claims. For example, the light-emitting type of volume number encoder could be replaced with other types of number encoders, including mechanical switches.

What is claimed is:

1. A method of synthesizing an audible note comprising the steps of:

generating a time-spaced series of digital amplitude numbers representing the average amplitude of the note at discrete instants in time, said step of generating a time-spaced series of digital amplitude numbers comprising the separate steps of generating a time-spaced series of digital volume numbers representing the average volume component of the note amplitude and generating a time-spaced series of digital envelope numbers representing the attack or decay envelope component of the note amplitude;

generating a time-spaced series of digital wave numbers representing the waveshape and fundamental frequency characteristics of the note at discrete instants in time;

converting the series of digital amplitude numbers into a corresponding analog amplitude signal;

multiplying the value of the analog amplitude signal and the digital wave numbers together to generate an analog tone signal; and converting the analog tone signal into the audible note, whereby the composite and complex characteristics of the note can be rapidly generated in real time.

2. A method, as claimed in claim 1, wherein:

the step of converting the series of digital amplitude numbers comprises the steps of generating a reference analog signal, multiplying the value of the reference analog signal and the digital volume numbers together to form a volume analog signal, multiplying the values of the volume analog signal and the digital envelope numbers together to form the analog amplitude signal, and multiplying the values of the analog amplitude signal and the digital wave numbers together to form the analog tone signal.

3. Electronic apparatus for synthesizing an analog tone signal suitable for conversion to an audible note comprising:

amplitude generator means for generating a time-spaced series of digital amplitude numbers representing the amplitude of the note at discrete instants in time, said amplitude generator means comprising separate generator means for generating a separate and distinct time-spaced series of digital volume numbers representing the volume component of the note amplitude at discrete instants in time and separate and distinct envelope generator means for generating a separate and distinct time-spaced series of digital envelope numbers representing the attack or decay envelope component of the note amplitude at discrete instants in time;

waveshape generator means for generating a time-spaced series of digital wave numbers representing the waveshape and fundamental frequency characteristics of the note at discrete instants in time; and conversion means for converting and combining the series of digital numbers representing respectively the volume of the note, the attack or decay envelope of the note, and the waveshape and fundamental frequency of the note into an analog tone signal, whereby the composite complex characteristics of a note can be rapidly generated and combined into a tone signal in real time, said conversion means comprising first converter means for multiplying the value of a reference analog signal and the digital volume numbers together to form a volume analog signal, second converter means for multiplying the values of the volume analog signal and the digital envelope numbers together to form the analog amplitude signal, and third converter means for multiplying the values of the analog amplitude signal and the digital wave numbers together to form the analog tone signal.

4. Apparatus, as claimed in claim 1, wherein the first converter means, the second converter means and the third converter means each comprises a multiplying digital-to-analog converter and digital latch means connected as input respectively to each said multiplying digital-to-analog converter.

5. Electronic apparatus for simultaneously synthesizing a first tone signal and a second tone signal suitable for conversion to a first audible note and a second audible note comprising:

first amplitude generator means for generating a time-spaced series of first digital amplitude numbers representing the average amplitude of the first note at discrete instants in time, said first amplitude generator means comprising volume generator means for generating a time-spaced series of first digital volume numbers representing the average volume component of the first note amplitude at discrete instants in time and envelope generator means for generating a time-spaced series of first envelope numbers representing the attack or decay envelope component of the first note amplitude at discrete instants in time;

second amplitude generator means for generating a time-spaced series of second digital amplitude numbers representing the average amplitude of the second note at discrete instants in time, said second amplitude generator means comprising volume generator means for generating a time-spaced series of second digital volume numbers representing the average volume component of the second note amplitude at discrete instants in time and envelope generator means for generating a time-spaced series of second digital envelope numbers representing the attack or decay envelope component of the second note amplitude at discrete instants in time;

first waveshape generator means for generating a time-spaced series of first digital wave numbers representing the waveshape and fundamental frequency characteristics of the first note at discrete instants in time;

second waveshape generator means for generating a time-spaced series of second digital wave numbers representing the waveshape and fundamental frequency characteristics of the second note at discrete instants in time;

first conversion means for converting the series of first digital amplitude numbers into a corresponding first analog amplitude signal and for multiplying the value of the first analog amplitude signal and the first digital wave numbers together to form a first analog tone signal; and second conversion means for converting the series of second digital amplitude numbers into a corresponding second analog amplitude signal and for multiplying the value of the second analog amplitude signal and the second digital wave numbers together to form a second analog tone signal, whereby independent control can be maintained over the amplitude and waveshape characteristics of the first and second tone signals or any resulting audible notes.

6. Apparatus, as claimed in claim 4, wherein:

the first conversion means comprises first converter means for multiplying the value of a reference analog signal and the first digital volume numbers together to form a first volume analog signal, second converter means for multiplying the values of the first volume analog signal and the first digital envelope numbers together to form the first analog amplitude signal, and third converter means for multiplying the values of the first analog amplitude signal and the first digital wave numbers together to form the first analog tone signal.

7. Apparatus, as claimed in claim 6, wherein the first, second and third converter means each comprises a multiplying digital-to-analog converter and latch means connected as input to each said multiplying digital-to-analog converter.

8. An electronic musical instrument for synthesizing an audible note comprising:

performer controllable key means for selecting the note to be synthesized;

waveshape generator means for generating a time-spaced series of digital wave numbers representing the waveshape and fundamental frequency characteristics of the note at discrete instants in time;

performer controllable volume means for generating a time-spaced series of digital volume numbers representing the average volume of the note at discrete instants in time;

envelope generator means for generating a time-spaced series of digital envelope numbers representing the attack or decay envelope of the note at discrete instants in time;

first converter means for multiplying the value of a reference analog signal and the digital volume numbers together to form a volume analog signal;

second converter means for multiplying the values of the volume analog signal and the digital envelope numbers together to form the analog amplitude signal;

third converter means for multiplying the values of the analog amplitude signal and the digital wave numbers together to form an analog tone signal; and output means for converting the analog tone signal into the audible note, whereby the composite complex characteristics of the note can be rapidly generated and combined in real time.

9. Apparatus, as claimed in claim 8, wherein the first, second and third converter means each comprises a multiplying digital-to-analog converter and latch means connected as input to each said multiplying digital-to-analog converter.

10. An electronic musical instrument for simultaneously synthesizing a first audible note and a second audible note comprising:

first performer controllable key means for selecting the first note for synthesizing;

first performer controllable volume means for generating a time-spaced series of first digital volume numbers representing the average volume component of the first note amplitude at discrete instants in time;

first envelope generator means for generating a time-spaced series of first digital envelope numbers representing the attack or decay envelope of the first note at discrete instants in time;

second performer controllable volume means for generating a time-spaced series of second digital volume numbers representing the average volume of the second note at discrete instants in time;

second envelope generator means for generating a time-spaced series of second digital envelope numbers representing the attack or decay envelope of the second note at discrete instants in time;

first waveshape generator means for generating a time-spaced series of first digital wave numbers representing the waveshape and fundamental frequency characteristics of the first note at discrete instants in time;

second waveshape generator means for generating a time-spaced series of second digital wave numbers representing the waveshape and fundamental frequency characteristics of the second note at discrete instants in time;

first converter means for multiplying the value of a reference analog signal and the first digital volume numbers together to form a first volume analog signal;

second converter means for multiplying the values of the first volume analog signal and the first digital envelope numbers together to form a first analog amplitude signal;

third converter means for multiplying the values of the first analog amplitude signal and the first digital wave numbers together to form the first analog tone signal;

fourth converter means for multiplying the value of a reference analog signal and the second digital volume numbers together to form a second volume analog signal;

fifth converter means for multiplying the values of the second volume analog signal and the second digital envelope numbers together to form a second analog amplitude signal;

sixth converter means for multiplying the values of the second analog amplitude signal and the second digital wave numbers together to form the second analog tone signal; and output means for simultaneously converting the first and second tone signals into the first and second audible notes, whereby independent control can be maintained over the amplitude and waveshape characteristics of the first and second notes.

11. Apparatus, as claimed in claim 10, wherein the first, second, third, fourth, fifth and sixth converter means each comprises a multiplying digital-to-analog converter and latch means connected as input to each said multiplying digital-to-analog converter.

12. Electronic apparatus for synthesizing an analog tone signal suitable for conversion to an audible note comprising, in combination: volume generator means for generating a time-spaced discrete series of digital volume numbers representing the volume component of the note amplitude at discrete instants in time; envelope generator means for generating a time-spaced discrete series of digital envelope numbers representing the attack and decay envelope components of the note amplitude at discrete instants in time; wave generator means for generating a time-spaced discrete series of digital wave numbers representing the waveshape and fundamental frequency components of the note at discrete instants in time; and means operable to convert and combine the digital numbers representative of the volume of the note, the attack and decay envelope of the note and the waveshape and fundamental frequency of the note into a tone signal in real time, said means operable to convert and combine comprising the combination of digital latch means and multiplying digital-to-analog converter means that receives the digital numbers representative of the volume of the note, the attack and decay envelope of the note and the waveshape and fundamental frequency of the note and converts and combines said digital numbers to provide said tone signal in real time.

* * * * *